United States Patent [19]

Good et al.

[11] 4,287,031

[45] Sep. 1, 1981

[54] PORTABLE ELECTROLYSIS UNIT FOR RECOVERY OF PRECIOUS METALS

[76] Inventors: David L. Good, 3708 Hickman, Des Moines, Iowa 50310; Dallis L. Good, P.O. Box 1354, Middlesboro, Ky. 40965

[21] Appl. No.: 146,298

[22] Filed: May 5, 1980

[51] Int. Cl.[3] ..... C25C 1/20; C25C 7/00; C25B 11/04

[52] U.S. Cl. ..... 204/109; 204/271; 204/292; 204/294

[58] Field of Search ..... 204/271, 109, 294, 292, 204/224 R, 150, 248

[56] References Cited

U.S. PATENT DOCUMENTS

| | | | |
|---|---|---|---|
| 2,421,027 | 5/1947 | Isaacson | 204/271 |
| 3,346,477 | 10/1967 | Wolfer | 204/224 R |
| 3,458,425 | 7/1969 | Tolle et al. | 204/109 UX |
| 3,524,805 | 8/1970 | Engelman | 204/109 X |
| 3,663,416 | 5/1972 | Cooper et al. | 204/271 X |

*Primary Examiner*—Donald R. Valentine

*Attorney, Agent, or Firm*—Zarley, McKee, Thomte, Voorhees & Sease

[57] ABSTRACT

The device is a small, portable receptacle having a top closure and a bottom closure which are sealingly joined to define an interior cavity which holds a small battery. A cathode plate is in electrical contact with the negative terminal of the battery and extends through the bottom closure for direct contact with electrolyzing solution, and an anode is in electrical contact with the positive terminal of the battery and extends through the top closure for direct contact with electrolyzing solution. The unit is especially designed for use to recover silver from photographic fixing solution.

7 Claims, 8 Drawing Figures

PORTABLE ELECTROLYSIS UNIT FOR RECOVERY OF PRECIOUS METALS

BACKGROUND OF THE INVENTION

As is well known, silver bromide is the light sensitive compound that is responsible for the production of all types of photographs. The silver bromide, a cream white solid, is dispersed in gelatin and the mixture is spread on the cellulose or film. In some cases, silver chloride and silver iodide may be used for special purpose films. After the film has been exposed, it is placed in a developing bath, for example hydroquinone, or some other reducing agent, to reduce the silver bromide to pure silver. This forms the negative. The film is now transferred to a stop bath to halt the action of the developer and then to a fix bath to dissolve the excess silver halide which receive no light. Typically, the fix bath, or fixer solution, commonly known as HYPO, is sodium thiosulfate. It solubilizes the silver halide to form a water soluble, silver thiosulfate complex. Eventually, the thiosulfate in the fixer becomes used and the fixing solutions must be replaced. There is, however, valuable silver in solution in the form of complex ions.

With the ever-increasing price of precious metals, it is desirable to recover the silver in metal form so that it may be sold. This is commonly done in industrial photography processes. However, with the ever-escalating price, it is desirable even for amateur photographers, to accomplish this. Most amateur photographers do not have access to large electrolysis units for electrolyzing spent fixing solution.

Accordingly, a primary object of this invention is to provide a small portable electrolysis unit for recovery of precious metals, especially silver, from waste solutions such as photographer's HYPO.

A further object of this invention is to provide only a portable, small electrolysis unit which may be conveniently used by home and/or amateur photographers, but provide a unit which is inexpensive, which facilitates recovery of silver as pure as 97% and to provide a unit which is economical to manufacture.

An even further object of the invention is to provide a portable electrolysis unit usable by amateur photographers which avoids the necessity for use of complex filtering systems or centrifuge systems to recover the majority of the silver plating out during the electrolysis process.

The method and manner of accomplishing each of these objectives, as well as others, will become apparent from the detailed description of the invention which follows.

SUMMARY OF THE INVENTION

A small portable electrolysis unit adapted especially for use by home photographers to recover free silver from spent photographer's HYPO solution. The unit is electrically operated by a small replaceable battery. The unit is merely placed in the fixing solution, and free silver is deposited on the cathode plate. The cathode plate is thereafter removed, the cathode flexed and the free silver shakes off so that it may be gathered. Thus, the necessity for centrifuging or other complex separation schemes, none of which are practical for an amateur photographer, is avoided.

DETAILED DESCRIPTION OF THE INVENTION

Figure 1:
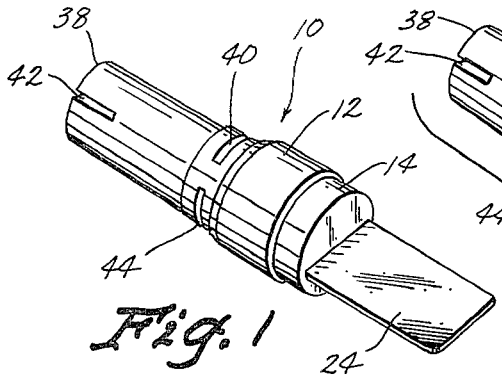
FIG. 1 is a perspective view of the device of the invention.
Figure 2:
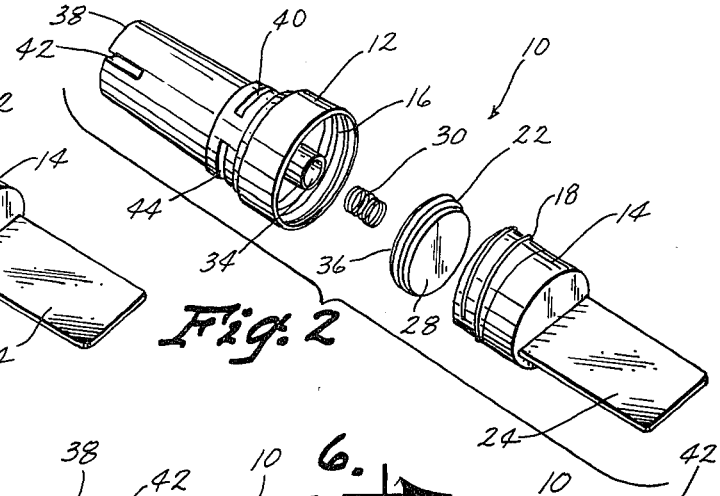
FIG. 2 is an exploded view, showing component parts of the device.
Figure 4:
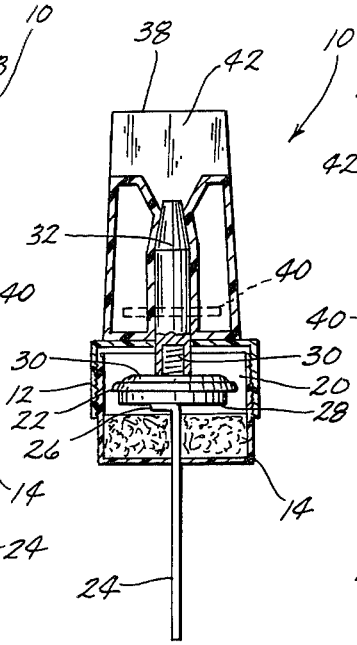
FIG. 4 is a sectional view along line 4—4 of FIG. 3.
Figure 5:
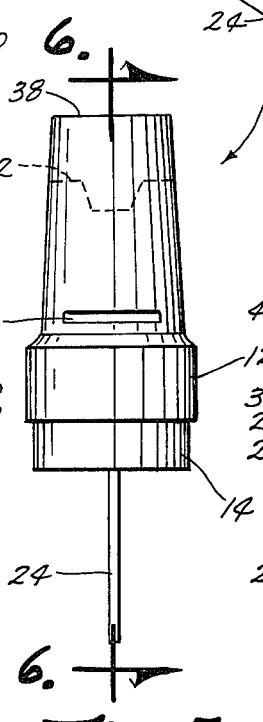
FIG. 5 is a frontal side view of the device, rotated 90° from the view of FIG. 3.
Figure 6:
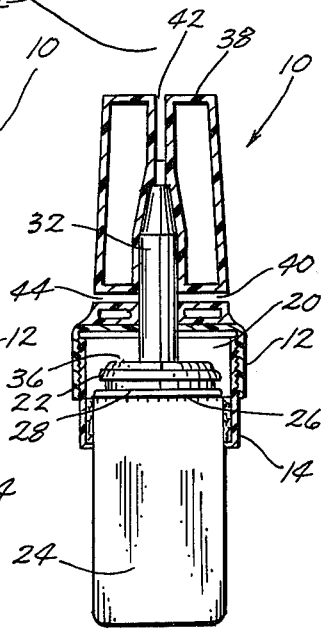
FIG. 6 is a sectional view along line 6—6 of FIG. 5.

In looking, especially at FIGS. 2, 4 and 6, it can be seen that the portable electrolysis unit 10 is comprised of a top closure 12, and a bottom closure portion 14. Threads 16 of top closure 12 and 18 of bottom closure 14, are provided so that bottom closure 14 may be threadably received into top closure 12 to define an interior cavity portion 20. Members 12 and 14 may be made of suitable inert plastic material such as polyethylene, polyvinylchloride, polypropylene or the like. When bottom closure 14 is threadably received in top closure 12, a seal is formed to prevent liquid access to interior cavity portion 20.

A conventional dry cell battery having positive and negative terminals, 22, is positioned within cavity portion 20. Suitable small disc shaped batteries are well known and commonly used in cameras. Often they are cadmium sulfide activated batteries. One face of such disc shaped batteries 22 is positive and the opposite face negative. For further details with regard to such batteries, see U.S. Pat. No. 3,069,489 for illustrative purposes.

Extending through bottom closure 14 is a stainless steel, thin, blade-like cathode 24.

As best seen in FIG. 4, cathode 24 extends completely through bottom closure 14 and has a contact tab portion bent at right angles to longitudinal axis of cathode 24 so that it may contact the negative surface 28 of battery 22. Cathode 24 may be held in suitable position within bottom closure 14 by substantially inert glues or other suitable adhesive materials.

Positioned on the top of battery 22 in electrically conductive relationship with the anode is biasing spring 30. When the unit is in closed relationship as seen in FIGS. 3, 4, 5 and 6, spring 30 urges the battery 22 against contact tab 26 of cathode 24, thus preventing the battery 22 from moving around within interior cavity 20.

Turning now to a further description of the top 12, an anode, preferably a carobon rod, 32, extends though top 12 and at its bottom end thereof has a small spring receiving cavity 34. Thus, as best depicted in FIG. 4, spring 30 may rest in cavity portion 34 and when top 12 is threadably received on bottom 14, spring 30 rests in part on the anode or top surface of battery 22 biasing that battery downwardly against cathode 24. It is not essential that biasing spring 30 be electrically conductive since the bottom of anode 32 is also in contact with the top surface of cell or battery 22 shown at 36. It is, however, preferred that the spring member also be electrically conductive to assure maximizing electrical contact.

Figure 3:
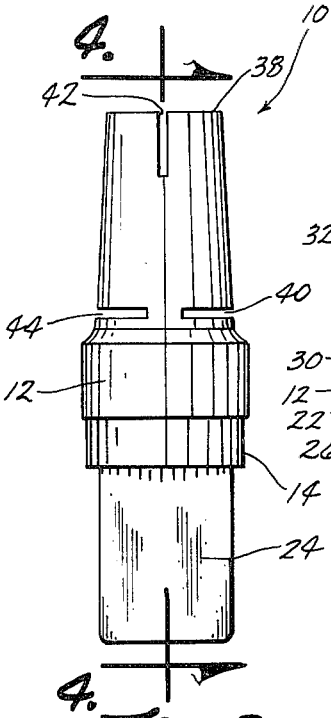
FIG. 3 is an elevated side view.

Positioned over top 12, primarily for convenience purposes of handling, is anode cover or housing 38. As shown in FIG. 3, it can be seen that housing 38 has slots 40, 42 and 44. Slots 40, 42, and 44 are necessary to provide access of electrolyzing solution to the anode. Housing 38 may be formed as a part of top 12, or may be a separate and distinct piece mounted to top 12. Further, it should be mentioned, and it goes without saying, that anode 32 may be attached to top 12 by any suitable attaching means including adhesive materials, fastening clips or the like.

Surprisingly, it has been found that when housing 38 is employed, as opposed to allowing complete access of anode 32, to electrolyzing solution 46, the recovered silver seems to have a higher degree of purity and is much less dark in color.

Figure 7:
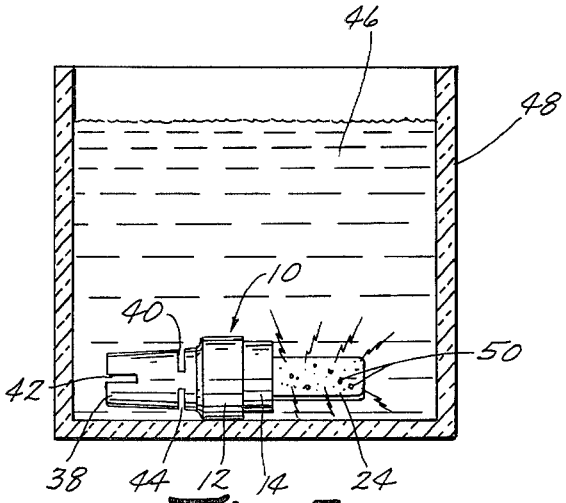
FIG. 7 is the device shown in use in a spent photographer's HYPO solution.
Figure 8:
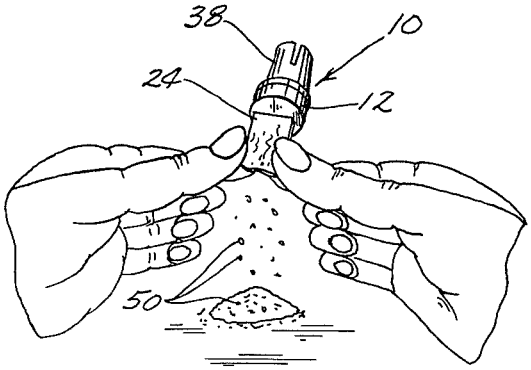
FIG. 8 shows how the user may conveniently shake electrolysis reduced free silver from the cathode of the device.

In actual operation, the unit works as follows: With continuing reference to FIG. 7, there is shown a vessel 48 containing spent photographer's HYPO 46. The portable electrolysis unit 10 is dropped into the spent fixer solution. Assuming normal quantities used by amateur photographers, in about two and one-half hours the electrolysis reaction will be completed. The silver extracted by electrolyzing from the silver thiosulfate complex of the fixer solution, is deposited on cathode 24 as depicted at 50. When the electrolysis, and therefore the silver depositing, is completed, the unit is removed from vessel 48 and the user simply flexes cathode 24 as depicted in FIG. 8, and the silver 50 drops therefrom. In this manner, the home user avoids the necessity of having expensive solid liquid separation units which would make silver recovery uneconomical for the typical amateur photographer.

When battery 22 is completely spent, bottom 14 is merely unscrewed from top 12, battery 22 discarded, and a new battery replaced.

It therefore can be seen that the device of the invention accomplishes all of its stated objectives.

What is claimed is:

1. A portable electrolysis unit for recovery of precious metals from waste solutions containing said metals, comprising: a small receptacle having a top closure portion and a bottom closure portion which can be sealingly joined to define an interior cavity;

a direct current battery cell having positive and negative terminals, resting in said interior cavity, a cathode plate in electrical contact with the negative terminal of said battery and extending through said bottom closure for easy access and direct contact with waste solutions for electrolysis;

an anode in electrical contact with the positive terminal of said battery, and extending through said top closure for contact with waste solution for hydrolysis said anode being a graphite rod.

2. The device of claim 1 wherein the top and bottom closure portions are releaseably joined, as well as sealingly joined, so that they may be opened and closed for access to the interior cavity.

3. The device of claim 1 wherein the electrical connection between said anode and the positive terminal of said battery is in part a small, electrically conductive spring which biases said battery to a secure position in said interior cavity.

4. The device of claim 3 wherein said top and bottom closure portions are threadably joined.

5. A portable electrolysis unit for recovery of precious metals from waste solutions containing said metals, comprising:

a small receptacle having a top closure portion and a bottom closure portion which can be sealingly joined to define an interior cavity;

a direct current battery cell having positive and negative terminals, resting in said interior cavity, p1 a cathode plate in electrical contact with the negative terminal of said battery and extending through said bottom closure for easy access and direct contact with waste solutions for electrolysis;

an anode in electrical contact with the positive terminal of said battery, and extending through said top closure for contact with waste solution for hydrolysis, said cathode being a thin flexible stainless steel plate which may be flexed to release deposited precious metals.

6. A portable electrolysis unit for recovery of precious metals from waste solutions containing said metals, comprising:

a small receptacle having a top closure portion and a bottom closure portion which can be sealingly joined to define an interior cavity;

a direct current battery cell having positive and negative terminals, resting in said interior cavity, a cathode plate in electrical contact with the negative terminal of said battery and extending through said bottom closure for easy acecess and direct contact with waste solutions for electrolysis;

an anode in electrical contact with the positive terminal of said battery, and extending through said top closure for contact with waste solution for hydrolysis said anode being surrounded by a housing having an opening therein to allow liquid access.

7. A method for recovering silver from a waste material solution containing silver ions, said method comprising:

placing a small receptacle in said waste solution, said receptacle having a top closure portion and a bottom closure portion which can be sealingly joined to define an interior cavity, a direct current battery cell having positive and negative terminals resting in said interior cavity, a cathode plate in electrical contact with the negative terminal of said battery and extending through said bottom closure and being in contact with said solution, and an anode in electrical contact with the positive terminal of said battery and extending through said top closure so as to be in contact with said solution;

leaving said receptacle in said solution long enough for silver to collect on said cathode by electrolysis;

removing said receptacle from said solution; and removing said silver from said cathode.

* * * * *